US006048375A

United States Patent [19]

Yang et al.

[11] Patent Number: 6,048,375

[45] Date of Patent: Apr. 11, 2000

[54] COATED ABRASIVE

[75] Inventors: Wenliang Patrick Yang, Ballston Lake; Paul Wei, Amherst; Gwo Shin Swei, East Amherst; Anthony C. Gaeta, Lockport, all of N.Y.

[73] Assignee: Norton Company, Worcester, Mass.

[21] Appl. No.: 09/212,664

[22] Filed: Dec. 16, 1998

[51] Int. Cl.[7] ..... B24D 3/28; B24D 17/00

[52] U.S. Cl. ..... 51/306; 51/298; 51/295; 51/297; 51/293

[58] Field of Search ..... 51/295, 298, 293, 51/306, 297

[56] References Cited

U.S. PATENT DOCUMENTS

| | | | |
|---|---|---|---|
| 4,828,948 | 5/1989 | Ahne et al. . | |
| 4,883,730 | 11/1989 | Ahne et al. . | |
| 4,975,347 | 12/1990 | Ahne et al. . | |
| 5,543,262 | 8/1996 | Sypek et al. . | |
| 5,667,541 | 9/1997 | Klun et al. | 51/295 |
| 5,692,950 | 12/1997 | Rutherford et al. | 51/293 |
| 5,700,302 | 12/1997 | Stoetzel et al. | 51/295 |

*Primary Examiner*—Michael Marcheschi
*Attorney, Agent, or Firm*—David Bennett

[57] ABSTRACT

Abrasive tools, such as coated abrasives, made using radaition curable resin binders can be given a greater depth of cure of the binder if they include an acylphosphine oxide initiator.

9 Claims, 5 Drawing Sheets

819 DEPTH OF CURE COMPARED TO 651

369 DEPTH OF CURE COMPARED TO 651

907 DEPTH OF CURE COMPARED TO 651

ADHESION FOR 819 PHOTO INITIATOR

ADHESION FOR 651 PHOTO INITIATOR

COATED ABRASIVE

BACKGROUND

The present invention relates to coated abrasives and specifically to coated abrasives in which the abrasive particles are held in position by a UV-curable binder.

In the manufacture of coated abrasives, abrasive particles are usually adhered to a backing material by a maker coat and a size coat is placed over the abrasive particles to anchor them in place. Sometimes a supersize coat is applied over the size coat to impart some special property such as anti-loading, antistatic character or to place a grinding aid at the point at which the abrasive particles contact a work piece during use.

Binders most frequently used for the maker and size coats in such structures were and still are phenolic resins though other thermosetting resins have also been used at times. However such binders are slow to cure and require expensive drying and curing equipment to be effective. For this reason in part faster curing binders including those cured using UV radiation have been proposed and to some extent adopted.

As used herein it is understood that the term "UV-cured or UV-curable" embraces resins that can be cured by exposure to actinic light in the visible or ultraviolet part of the spectrum and to electron beam radiation.

Cure of such binder is accelerated by the use of one of a number of classes of photoinitiators which generate free radicals when exposed to UV light. These groups of free-radical generators include organic peroxides, azo compounds, quinones, benzophenones, nitroso compounds, acryl halides, hydrozones, mercapto compounds, pyrylium compounds, triacrylimidazoles, bisimidazoles, chloroalkyltriazines, benzoin ethers, benzil ketals, thioxanthones and acetophenones, including derivatives of such compounds. Among these the most commonly employed photoinitiators are the benzil ketals such as 2,2-dimethoxy-2-phenyl acetophenone (available from Ciba Specialty Chemicals under the trademark IRGACURE® 651) and acetophenone derivatives such as 2,2-diethoxyacetophenone ("DEAP", which is commercially available from First Chemical Corporation), 2-hydroxy-2-methyl-1-phenyl-propan-1-one ("HMPP", which is commercially available from Ciba Specialty Chemicals under the trademark DAROCUR® 1173), 2-benzyl-2-N,N-dimethylamino-1-(4-morpholinophenyl)-1-butanone, (which is commercially available from Ciba Specialty Chemicals under the trademark IRGACURE® 369); and 2-methyl-1-(4-(methylthio) phenyl)-2-morpholinopropan-1-one, (available from Ciba Specialty Chemicals under the trademark IRGACURE® 907).

With the assistance of such photoinitiators such resins cure essentially completely in minutes rather than hours and therefore afford the opportunity for significant cost saving. They do however have a drawback in that, in the presence of solid materials, the cure is often incomplete in areas shielded from the activating light. This can happen as the result of the incorporation of pigments or fillers but it can also happen in the absence of solid materials and merely because the resin layer is particularly thick.

The shielding effect is perhaps acceptable where the resin is applied over abrasive grains such that the greater bulk of the resin is exposed to the UV light during cure. However certain newer products depart from the maker/abrasive particles/size structure by adding the binder and the abrasive particles in the form of a mixture in which the cured binder both adheres the mixture to the substrate backing and acts as a matrix in which the abrasive particles are dispersed. This mixture may be deposited in the form of a uniform layer on the substrate or in the form of a pattern comprising a plurality of composites in repeating patterns, each composite comprising abrasive particles dispersed in the binder, to form the so-called structured or engineered abrasives. It will be appreciated that the shielding effect in such products is quite significantly greater and tends to limit the size of the abrasive particles that can be used and the thickness of the abrasive/binder layer that may be deposited on a substrate.

Incomplete cure is particularly disadvantageous in portions of the structure where the resin contacts the substrate since it leads to poor adhesion to the substrate and poor adhesion leads to poor grinding performance. However this is precisely where the effect is at its most pronounced because it is where the depth of cure and shielding effects are most pronounced.

A new group of photoinitiators has now been discovered to be surprisingly effective in curing UV-curable resins to greater depths than hitherto considered possible without the assistance of thermal cure initiators. This leads to the possibility that relatively large composites can form part of engineered abrasive products. It also makes possible the elimination of thermal initiators to complete cure of the resin.

DESCRIPTION OF THE INVENTION

The present invention comprises a process for the production of an abrasive tool comprising abrasive particles bonded by a UV-curable resin binder in which the resin binder is present in a formulation which includes an acylphosphine oxide initiator.

The invention is particularly well adapted to use in the production of coated abrasives but it is also adaptable to the production of other abrasive tools such as thin wheels, and relatively thin segments. Wheels in which a solid wheel-shaped substrate is given a relatively thin abrasive coating around the circumference are also included. The invention however is most readily adaptable to the production of coated abrasives in which a slurry of abrasive particles in a radiation-curable binder is used to provide an abrasive surface on a substrate material. The coated abrasive is preferably one which is laid down with a relief patterned surface, or upon which a patterned surface, (an engineered abrasive), has been imposed such as is described in for example U.S. Pat. No. 5,014,468; U.S. Pat. No. 5,152,917; U.S. Pat. No. 5,833,724 and U.S. Pat. No. 5,840,088.

The radiation-curable binder can be any one of those that cure by a radiation initiated mechanism. Such resins frequently include polymers and copolymers of monomers with pendant polymerizable acrylate or methacrylate groups. They include acrylated urethanes, epoxy compounds, isocyanates and isocyanurates though these are often copolymerized with monomers such as N-vinyl pyrrolidone that have no (meth)acrylate group. Acrylated polyesters and aminoplasts are also known to be useful. Certain ethylenically unsaturated compounds are also found to be polymerizable by photoinitiated techniques. The most frequently employed binders are based on acrylated epoxies and/or acrylated urethanes and the formulation is chosen to balance rigidity, (primarily reflecting the density of cross-links between polymer chains), and modulus which reflects the lengths of the polymer chains. Achievement of a suitable rigidity can be accomplished by selection of suitable proportions of mono- and/or di- and/or trifunctional components for the binder formulation. Modulus control can be effected for example by selection of oligomeric components and/or by incorporation of a thermoplastic resin into the formulation. All such variations are understood to be embraced by the present invention, provided that radiation-cure of the formulation is accelerated by the use of an acylphosphine oxide initiator.

Polymerization of the resin component of the binder formulation is initiated as a rule by UV radiation to which the acylphosphine oxide used in the present invention are quite susceptible. However the resins can be polymerized under the influence of other radiation such as visible light, electron radiation or other actinic radiation. All such resins are understood to be embraced by the term "radiation-curable".

The initiator that is an essential component of the binder formulations used to make the abrasive tools of the invention is an acylphosphine oxide and this term is understood to embrace compounds having the formula:

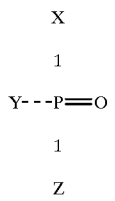

wherein at least one of X,Y and Z is selected from groups having the formula: R—CO.—, wherein R is a hydrogen or a substituted or unsubstituted alkyl, aryl, alkaryl, aralkyl or heterocyclic goup, and any one of X, Y and Z not comprising such an acyl group, is a hydrogen or a substituted or unsubstituted alkyloxy or phenoxy group or a substituted or unsubstituted alkyl, aryl, alkaryl, aralkyl or heterocyclic group.

Typical examples of such acylphosphine oxides include 2,4,6-trimethylbenzoyl, diphenylphosphine oxide ("TPO"); bis(2,6-dimethoxybenzoyl), 2,4,4-trimethylpentylphosphine oxide ("DMBAPO"); and bis(2,4,6-trimethylbenzoyl)-phenylphosphine oxide ("BTBPPO").

BTBPPO is available from Ciba Specialty Chemicals under the trademark IRGACURE® 819. DMBAPO is available from Ciba Specialty Chemicals in the form of blends with other ketones including:

25/75 wt % blend with 2-hydroxy-2-methyl-1-phenyl-propan-1-one, (or HMPP), (as IRGACURE® 1700); and 1-hydroxy-cyclohexyl-phenyl-ketone, (or HCPK), (as IRGACURE® 1850 or 1800 depending on proportions).

TPO is also available from Ciba Specialty Chemicals in 50/50 wt % blends with HMPP (as IRGACURE® 4265).

Phosphine oxides are available from BASF as 2,4,6-trimethylbenzoyl-diphenyl phosphine oxide, (as LUCIRIN® TPO) and 2,4,6-trimethylbenzoyl-ethoxyphenyl phosphine oxide, (as LUCIRIN® LR8893).

Thus the acylphosphine oxide initiator can be used alone or also in combination with photoinitiators or even thermal initiators if desired.

Where an abrasive/binder formulation is employed, this can also incorporate other components including but not limited to: fillers such as silica, talc, aluminum trihydrate and the like; and other functional additives such as grinding aids, adhesion promoters, antistatic or anti-loading additives and pigments.

DESCRIPTION OF PREFERRED EMBODIMENTS

Figure 1A:
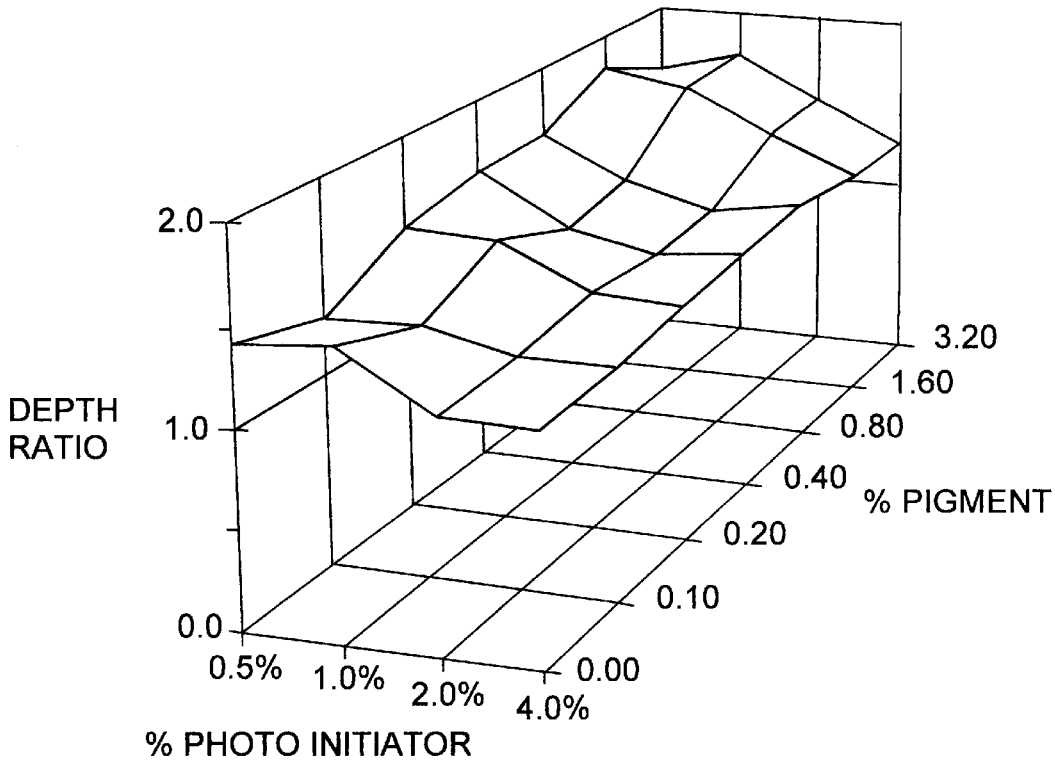
FIGS. 1(*a*), (*b*) and (*c*) are three-dimensional graphs comparing the depth of cure obtained using one initiator relative to the cure depth obtained when the other photoinitiator is used. Each graph compares different pairs. The relative cure depth is followed as the amount of photoinitiator and the amount of pigment are varied.

The invention is now described with reference to certain preferred embodiments which are provided to illustrate the invention and the advantages that it affords. They are not however intended to imply any necessary limitation of the scope of the invention.

EXAMPLE 1

This Example illustrates the depth of cure of various photoinitiators. A standard slurry of an acrylate-based binder comprising a predetermined amount of aluminum oxide abrasive particles with a grit size of P320 grit. The proportion of abrasive particles in the slurry was 17.39% by volume and the proportion of potassium tetrafluoroborate particles in the slurry was 27.29% by volume.

The slurry was made up in several samples differing only in the amount of 9R75 Quinn Violet pigment in the slurry. Four Irgacure photoinitiators were evaluated: 819 (an acylphosphine oxide); 651 (a benzyl ketal), 369 (an α-amino-acetophenone); and 907 (an α-amino-acetophenone). For each the depth of cure was determined at a number of pigment and photoinitiator concentrations. In each case the mixture was coated on a J-weight polyester woven substrate and passed beneath a UV light source (Fusion UV Systems, Inc., MD) consisting of a 600 watt V-bulb and a 300 watt H-bulb at a speed of 50 feet/minute, (15.2 meters/minute). Depth of cure was determined by the following method. The mix was poured into a foil container (1.5 inch (3.81 cm) in diameter by 0.375 inch (0.95 cm) deep) to a depth of 0.25 inch (0.635 cm). This was passed through UV unit. Any excess uncured resin was removed and the thickness of cured portion was then measured as the depth of cure.

Figure 1B:
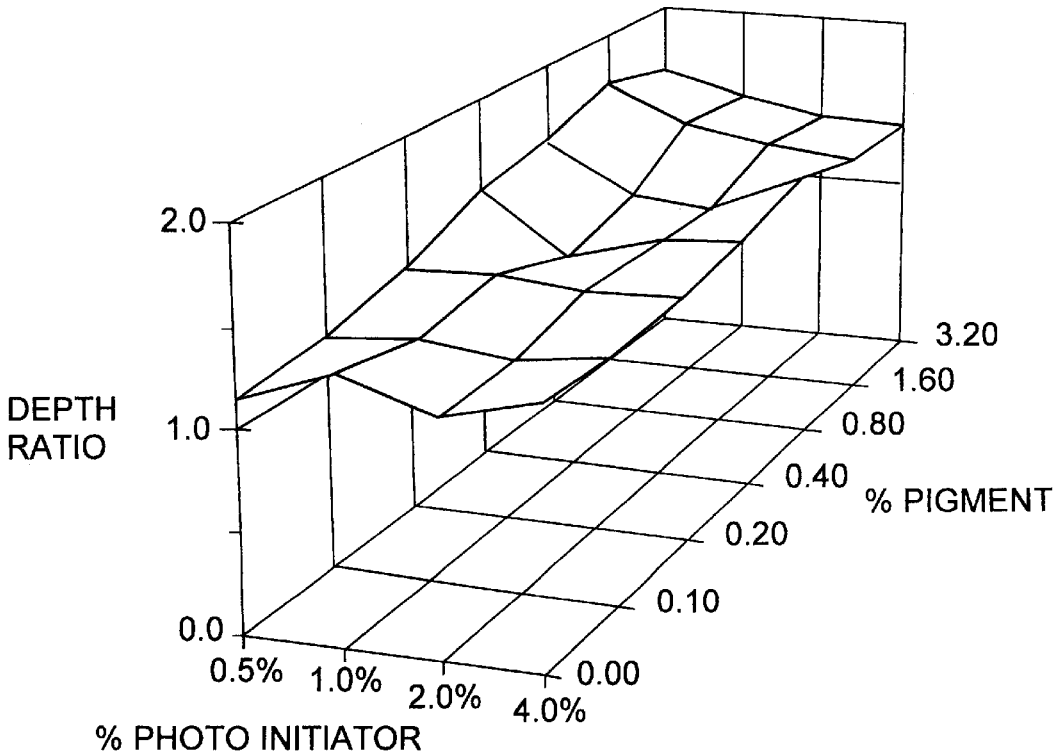
FIG. 1b PRIOR ART
Figure 1C:
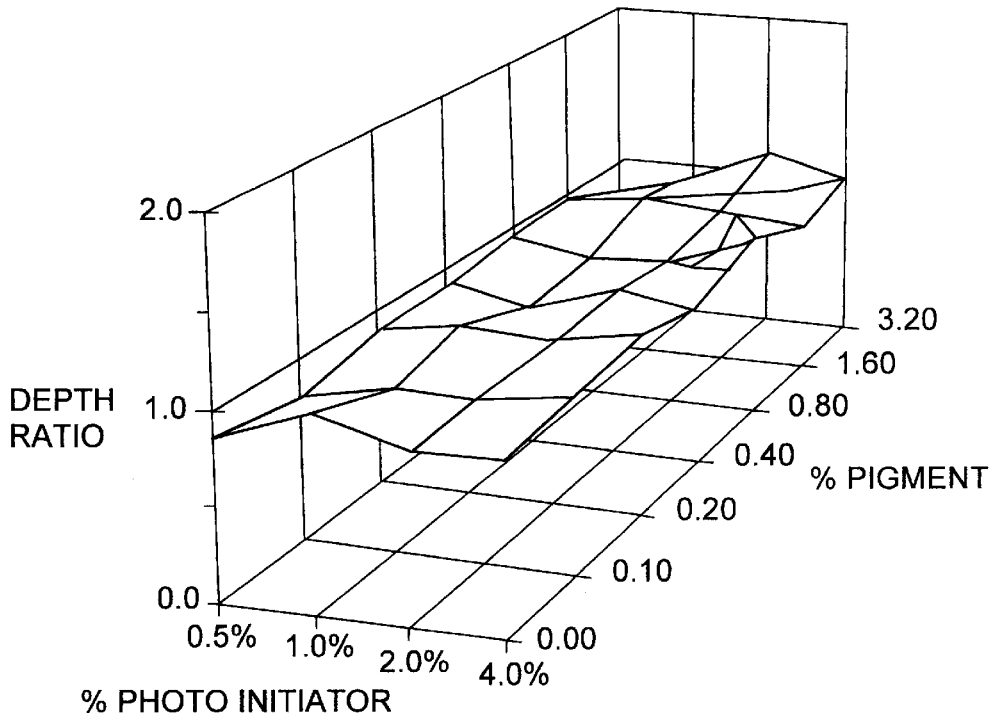
FIG. 1c PRIOR ART
Figure 2A:
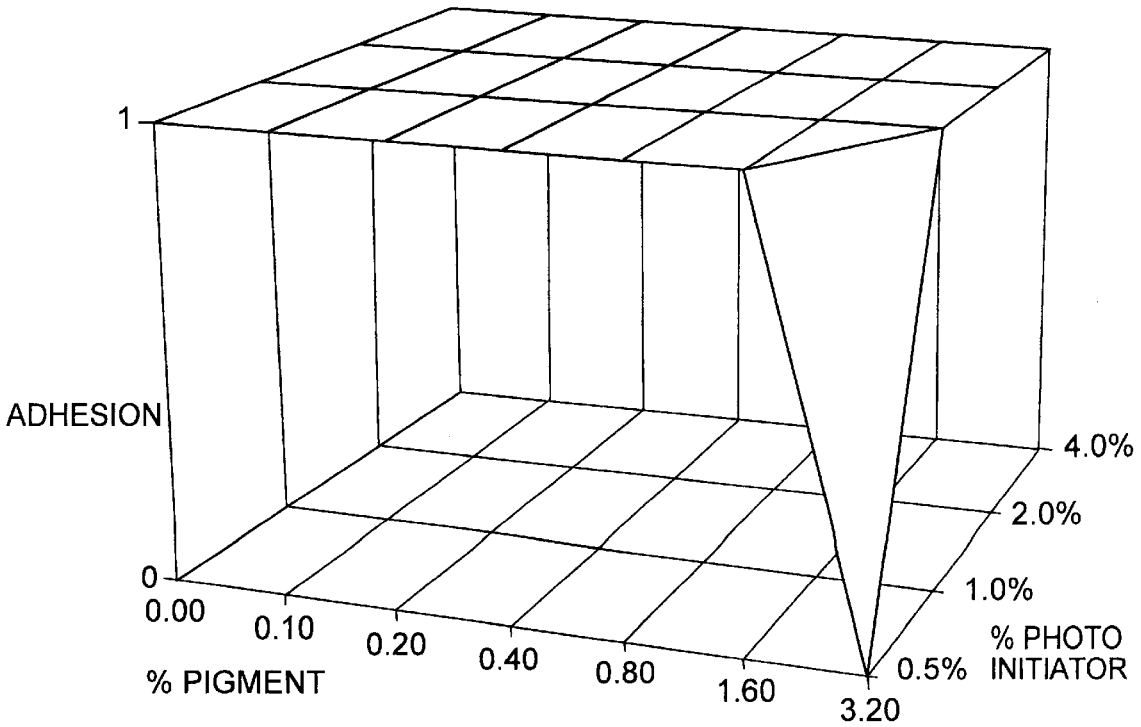
FIGS. 2(*a*) to (*d*) are three dimensional graphs showing the adhesion of a formulation to a substrate when the amount of photoinitiator and amount of pigment included in the formulation are varied. This is done for three different inititiators.
Figure 2B:
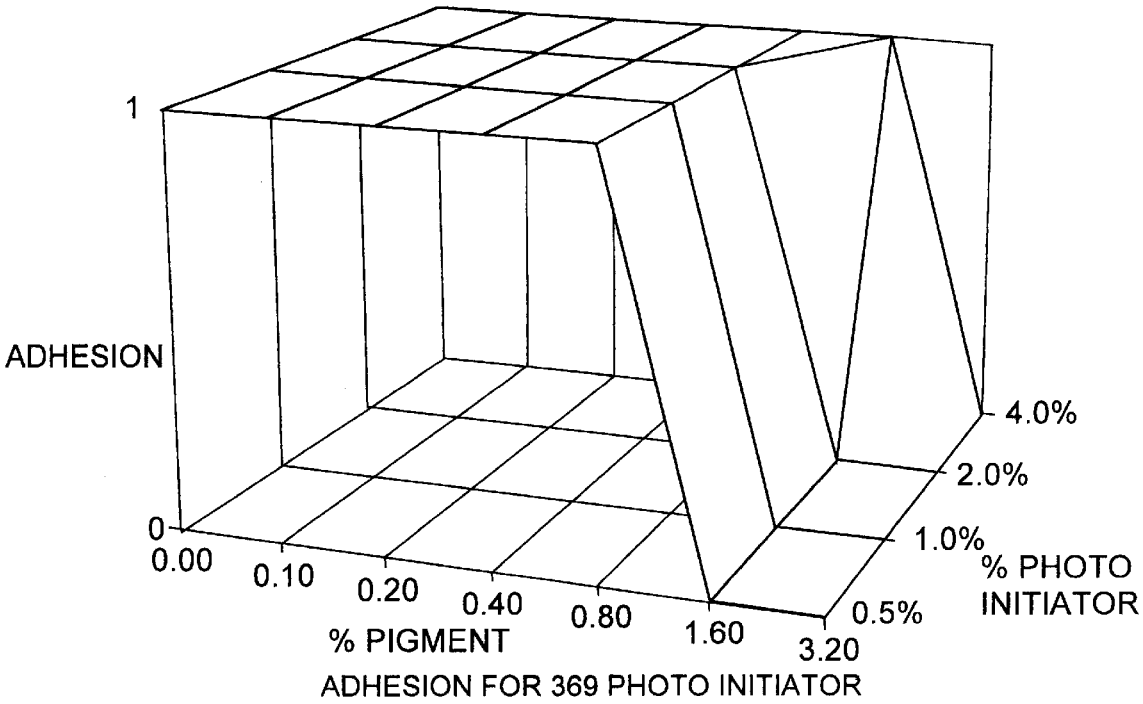
FIG. 2b PRIOR ART
Figure 2C:
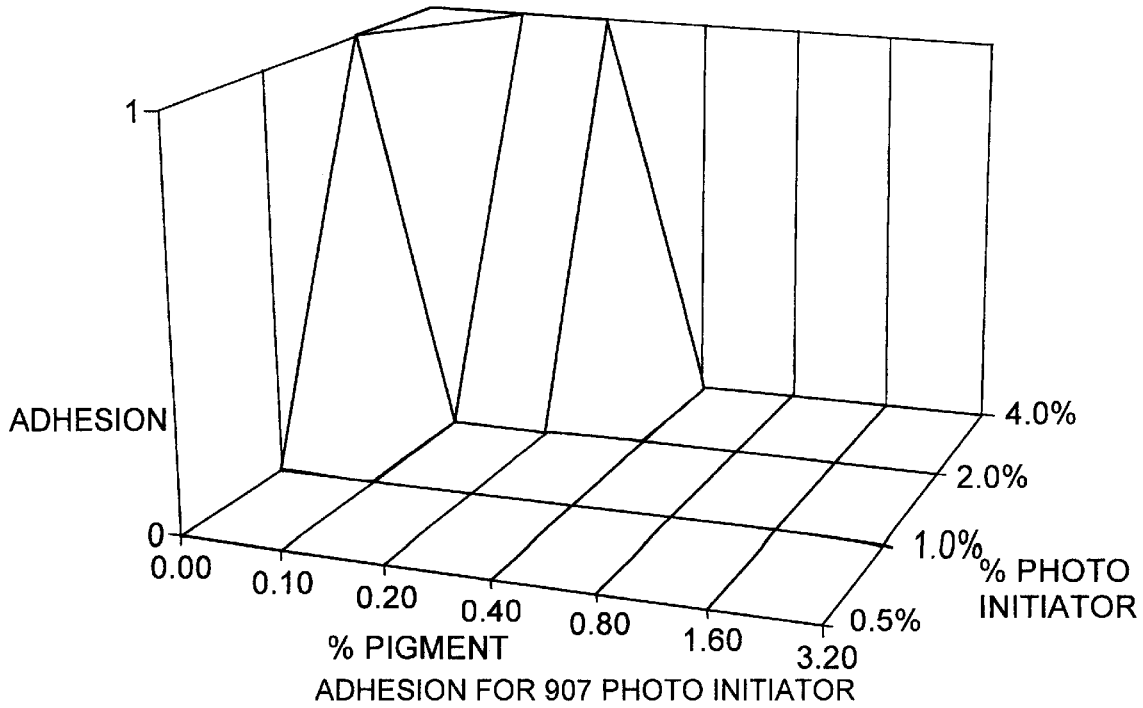
FIG. 2c PRIOR ART
Figure 2D:
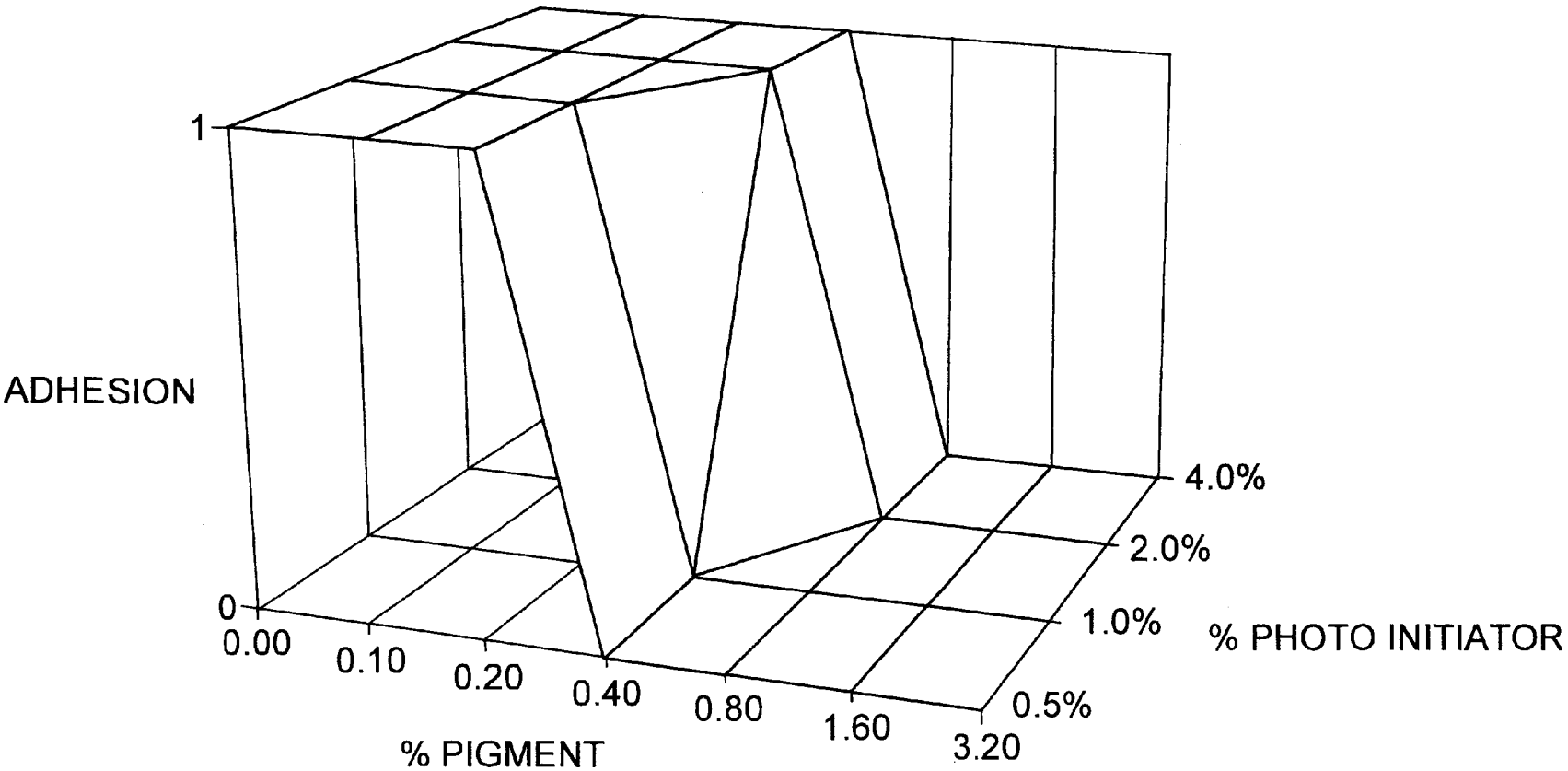
FIG. 2d PRIOR ART

The results are reported on the 3-Dimensional graphs attached as FIG. 1 (*a, b* and *c*). In each case the plot shows the ratio of cure depth for two photoinitiators. Thus a depth ratio of more than one indicates that one gives a greater cure depth than the photoinitiator against which it is being compared.

From FIG. 1(*a*) which compares the formulation containing the acylphosphine oxide photoinitiator, (819), against one with a conventional benzyl ketal initiator, (651), the acylphosphine oxide photoinitiator gives a uniformly greater cure depth. FIG. 1(*b*) shows that a formulation containing an α-amino-acetophenone photoinitiator, (369), outperforms 651 by almost the same amount as does 819. FIG. 1(*c*) shows that not all α-amino-acetophenone perform equally well since 907 is largely inferior to 651.

To give a more complete picture of the performance of the photoinitiators, the strength of adhesion between the cured coating and the polyester backing was determined. This test is a simple pass/fail test in which the cured material is subjected to an adhesion test by flexing the product over a sharp edge at 90 degree and a value of 1 was accorded to a product that did not separate and 0 was accorded if any separation occurred. FIG. 2(*a, b, c, d*) records the results in a 3-Dimensional chart for each of the four photoinitiators, 819, 369, 907 and 651 respectively. This shows that for the acylphosphine oxide photoinitiator, (FIG. 2*a*), failure only occurred at the highest pigment loading and the lowest photoinitiator content. Above 0.2% pigment content the 651 product, (FIG. 2*d*), failed consistently as did 369, (FIG. 2*b*), at pigment concentrations of 0.8% or greater except when the photoinitiator concentration was 4% in which case up to 1.6% pigment could be tolerated before failure occurred. Photoinitiator 907, (FIG. 2*c*), failed under all conditions except when the pigment content was below 0.1% and the photoinitiator concentration was at least 4%. These charts clearly confirm the evaluation from FIG. 1 and add the insight regarding adhesion to a substrate which demonstrates convincingly that the 819, (acylphoshine oxide), photoinitiator gives a much better range of satisfactory adhesion values than the very best α-amino-acetophenone, (369).

EXAMPLE 2

In this Example three formulations are used to produce a coated abrasive with a engineered surface. In each case the same acrylate binder was used along with P320 grit alumina abrasive grits in a volume percentage of 17.39% and potassium tetrafluoroborate in a volume percentage of 27.79%.

The backing used was an X weight woven cotton and the engineered abrasive surface was applied using the embossing technique described in U.S. Pat. No. 5,833,724. The pattern applied was a trihelical design with 25 lines per inch.

The performance of three engineered abrasives which differed only in the photoinitiator incorporated into the binder/abrasive formulation was evaluated using the following procedure.

The Examples described above were subjected to grinding tests using a modified 121 Fss Ring Test procedure. In each case a 6.4 cm×152.4 cm belt was used and the belt was moved at a rate of 1524 smpm. The belt was contacted with a 304 stainless steel ring workpiece, (17.8 cm O.D., 15.2 cm I.D., and 3.1 cm width), at a pressure of 16 psi (110 KN/m$^2$). The contact wheel behind the belt was a 7 inch (17.8 cm) plain face rubber wheel with 60 durometer hardness. The workpiece was moved at a speed of 3 smpm.

Twenty rings were pre-roughened to an initial Ra of 80 micro inch. The grinding intervals of one minute were followed by measurements of cut amount. With the twenty rings a total of 20 minutes grinding was performed with each belt and the total stock removal were reported.

In each case the initial cut after one minute and the total cut after 20 minutes were measured. The results are given in the Table below. The formulations are identified by the Irgacure photoinitiator used. The coated abrasive made according to the present invention appears in bold characters. The last line on the Table evaluates a conventional, commercial, non-engineered abrasive coated abrasive product.

| COATED ABRASIVE | INITIAL CUT | CUMULATIVE CUT |
|---|---|---|
| **IRGACURE ® 819** | **11.9 gm** | **163.6 gm** |
| IRGACURE ® 369 | 11.4 gm | 150.6 gm |

-continued

| COATED ABRASIVE | INITIAL CUT | CUMULATIVE CUT |
|---|---|---|
| IRGACURE ® 651 | 10.4 gm | 130.3 gm |
| R245 | 10.3 gm | 68.6 gm |

As will be appreciated from this Table the coated abrasive according to the invention handily outperformed similar products made using the better performing formulations as evaluated in Example 1 in this very critical "real-world" test.

EXAMPLE 3

Figure 3:
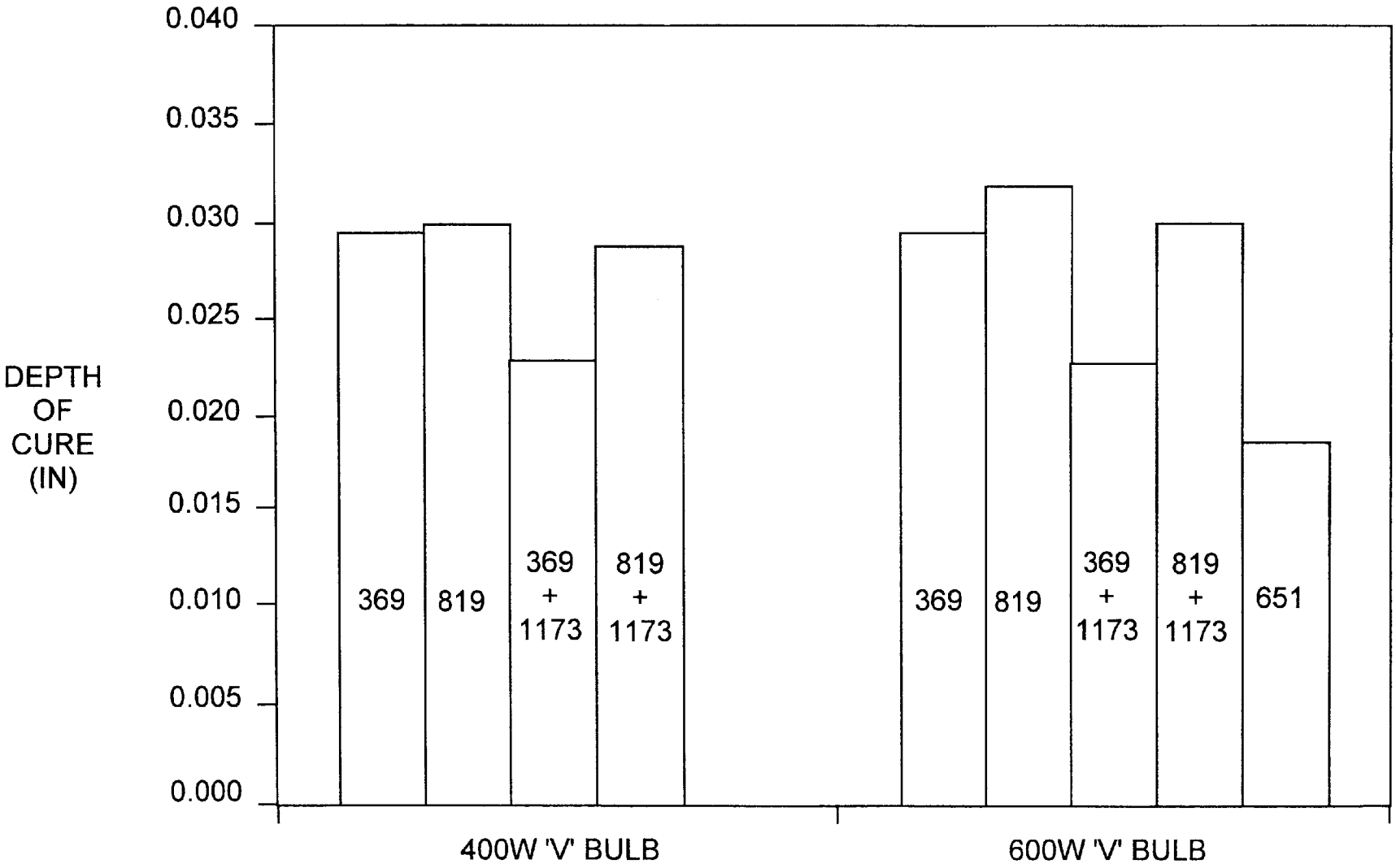
FIG. 3 is a bar graph showing depth of cure for various photoinitiators at two different radiation conditions.

In this Example the depth of cure and adhesion of formulations containing the same acrylate-based binder and silicon carbide abrasive grits, (grit size 150), in a volume percentage of 17.62% with potassium tetrafluoroborate in a volume percentage of 27.62% were evaluated. FIG. 3 compares the depth of cure of these formulations. These formulations differed only in the nature of the photoinitiator used. Each was deposited on an X weight woven cotton backing. Each was evaluated under two conditions: with no surface treatment; and with a surface treatment in which a mixture of silicon carbide abrasive grits (similar to those in the formulation) and a grinding aid, potassium tetrafluoroborate in a 2:1 weight ratio.

The adhesion test described in Example 1 was applied to these products. In the Table below "1" indicates a pass and "0" indicates a failure.

| PHOTOINITIATOR | UV SOURCE* | NO COATING | COATED SURFACE |
|---|---|---|---|
| 2% 819 | 400 watt (V-bulb) | 1 | 1 |
| 2% 819 | 600 watt (V-bulb) | 1 | 1 |
| 4% 819 | 400 watt (V-bulb) | 1 | 1 |
| 4% 819 | 600 watt (V-bulb) | 1 | 1 |
| 2% 819/1173* | 400 watt (V-bulb) | 1 | 0 |
| 2% 819/1173* | 600 watt (V-bulb) | 1 | 0 |
| 4% 819/1173* | 400 watt (V-bulb) | 1 | 1 |
| 4% 819/1173* | 600 watt (V-bulb) | 1 | 1 |
| 2% 369 | 400 watt (V-bulb) | 1 | 0 |
| 2% 369 | 600 watt (V-bulb) | 1 | 1 |
| 4% 369 | 400 watt (V-bulb) | 1 | 0 |
| 4% 369 | 600 watt (V-bulb) | 1 | 0 |
| 2% 369/1173* | 400 watt (V-bulb) | 1 | 0 |
| 2% 369/1173* | 600 watt (V-bulb) | 1 | 0 |
| 4% 369/1173* | 400 watt (V-bulb) | 1 | 0 |
| 4% 369/1173* | 600 watt (V-bulb) | 1 | 0 |
| 2% 651 | 600 watt (D-bulb) | 1 | 0 |
| 4% 651 | 600 watt (D-bulb) | 1 | 0 |

1173* refers to DAROCURE ® 1173 (2-hydroxy-2-methyl-1-phenyl propan-1-one, or HMPP) which is a photoinitiator available under that trade name from Ciba Special Chemicals.
UV SOURCE* In addition to the radiation source indicated, radiation from a 300 watt H-bulb was included in each case.
Where a blend is indicated the components were present in the following ratio: 819/1173 (1:3) and 369/1173 (1:3).

EXAMPLE 4

In this Example various engineered abrasives are evaluated f or their cutting power o n 6AL-4V titanium using a n evaluation technique in which a ⅝"×2⅜"×9¾" (15.9 mm×60.3 mm×247.7 mm) titanium workpiece was ground under 20 psi (138 KN/m$^2$). A plain face rubber contact wheel with a 40 D durometer hardness was used as the contact wheel. The belt speed was 3000 sfpm (914.4 smpm) and the work piece moved reciprocally at 7 sfpm (2.1 smpm).

The formulations were deposited on an X-weight woven cotton back ing in one of two patterns: trihelical (TH) with 25 lines per inch; and a pyramidal pattern (P) with 25 lines of pyramids per inch. The patterns were created by embossing the pattern on a surface of the slurry deposited on the substrate. The UV cure in each case was carried out using 300 Watt V bulb and 300 Watt H bulb from Fusion UV Systems, Inc., MD.

The total cut in ach case after 15 minutes was measured in each case. The results are set forth in the Table below.

| PATTERN | PHOTOINITIATOR USED | TOTAL CUT (gm) |
|---|---|---|
| 25P | 4% 819 | 21.7 |
| 25P | 1% 819 + 3% 1173 | 19.6 |
| 25P | 1% 819 + 3% 651 | 18.3 |
| 25P | 1% 819 + 3% 184 | 19 |
| 25TH | 4% 819 | 29.1 |
| 25TH | 2% 819 | 23.0 |
| 25TH | 1% 819 + 3% 1173 | 22.6 |
| 25TH | 1% 819 + 3% 651 | 21.5 |
| XCF0457* | | 12.9 |

*XCF 047 is a commercial non-engineered abrasive made using silicon carbide abrasive grits.

EXAMPLE 5

In this Example the depth of cure achieved by three different photoinitiators was compared. Each initiator was added to at the binder used in Example 1 but with no other additives or components being present with the initiator. The amount added was 1 wt % and the binder/initiator blend was applied to a substrate and the coated substrate was subjected to the radaition provided by a 300 W D bulb as the substrate moved under the source at 13.4 meters/minute. In a second evaluation the radiation source was a 600 W D bulb and the rate of passage under the source was also 13.4 meters/minute.

The initiators evaluated were IRGACURE® 700, (25% DMBAPO WITH 75% HMPP) and IRGACURE® 4265, (50% TPO with 50% HMPP), and these were compared to IRGACURE® 173, (HMPP) alone.

The Results are set out in the following Table:

| | DEPTH OF CURE | | |
|---|---|---|---|
| UV SOURCE | 1700 | 1173 | 4265 |
| 300 W D BULB | 2.75 mm | 1.35 mm | 1.85 mm |
| 600 W D BULB | 3.95 mm | 1.8 mm | 2.12 mm |

Thus it is apparent that the blends of the acylphosphine initiators with other initiators provides a deeper cure than the same total amount of either of the blended components.

From the data provided in the above Examples it is very clear that the acylphosphine oxide photoinitiators can be used alone or in conjunction with other photoinitiators to secure an improved depth of cure and better adhesion to the substrate and, as a consequence, to provide a good total cut that fully meets or exceeds commercial expectations.

What is claimed is:

1. A process for the production of an abrasive tool comprising providing abrasive particles and a curable binder formulation comprising a radiation-curable resin and a photoinitiator formulation comprising bis(2,4,6-trimethylbenzoyl)phenylphosphine oxide and curing the binder formulation by exposure to activating radiation such that the resin is at least partially cured and the abrasive particles are secured in fixed spatial relationship to one another.

2. A process according to claim 1 in which the bis(2,4,6-trimethylbenzoyl)phenylphosphine oxide photoinitiator is present in a blend with a ketone photoinitiator.

3. A process according to claim 1 in which the radiation-curable resin component of the formulation comprises a precursor formulation that, upon cure, provides at least one polymer selected from polymers and copolymers of monomers with pendant acrylate or methacrylate groups.

4. A process according to claim 1 in which the binder formulation is applied to a sheet of backing material before the resin component of the binder formulation is cured.

5. A process according to claim 4 in which the abrasive particles are dispersed in the binder formulation before the mixture is deposited on the backing material.

6. A process according to claim 5 in which the abrasive/binder mixture is deposited on the backing material and molded to provide a repeating pattern of relief structures before cure of the resin component of the binder formulation is completed.

7. A process according to claim 1 in which the abrasive particles are dispersed in the binder formulation and the binder/abrasive mixture is shaped into an abrasive tool before the resin component of the binder formulation is cured.

8. A process according to claim 7 in which the tool is an abrasive wheel.

9. An engineered abrasive made by a process according to claim 1.

* * * * *